US006227902B1

(12) United States Patent
Lin

(10) Patent No.: US 6,227,902 B1
(45) Date of Patent: May 8, 2001

(54) MODIFIED LINE LAMP

(76) Inventor: Jack Lin, No. 21, Alley 9, Lane 27, Sec. 5, Min Shen E. Rd., Taipei (TW)

( * ) Notice: Subject to any disclaimer, the term of this patent is extended or adjusted under 35 U.S.C. 154(b) by 0 days.

(21) Appl. No.: 09/442,141

(22) Filed: Nov. 17, 1999

(51) Int. Cl.[7] ..... H01R 13/60; H01R 35/00
(52) U.S. Cl. ..... 439/534; 362/269
(58) Field of Search ..... 439/534; 362/269, 362/287, 427

(56) References Cited

U.S. PATENT DOCUMENTS

| | | | | |
|---|---|---|---|---|
| 1,523,144 | * | 1/1925 | Snorf | 439/534 |
| 1,665,703 | * | 4/1928 | Kernes | 362/269 |
| 2,264,145 | * | 11/1941 | Chilo | 439/534 |
| 2,826,679 | * | 3/1958 | Irmischer et al. | 362/269 |
| 4,173,037 | * | 10/1979 | Henderson, Jr. et al. | 362/269 |
| 5,077,645 | * | 12/1991 | Habinak | 362/287 |
| 5,562,343 | * | 10/1996 | Chan et al. | 362/269 |
| 5,825,637 | * | 10/1998 | Chen | 362/427 |
| 6,036,337 | * | 3/2000 | Belfer | 362/269 |

* cited by examiner

*Primary Examiner*—Paula Bradley
*Assistant Examiner*—Antoine Ngandjui
(74) *Attorney, Agent, or Firm*—Rosenberg, Klein & Lee

(57) ABSTRACT

The present invention proposes a modified line lamp comprising a lamp and a lamp socket. The lamp socket is connected to a fixing seat. A retaining frame is connected with two sides of the fixing seat. Two sides of the retaining frame is connected to a main electric line. A hole is disposed at each of the two sides of the retaining frame not connected with a main electric line. The fixing seat extends to form two bent arms from a tubular seat. A joining seat installed at the outer side of the middle section of the bent arm is connected pivotally to the hole to let a joining element be joined with the joining seat such that the fixing seat can swing. A locking member is installed at the end of the bent arm of the fixing seat to be locked with the periphery of the lamp. The main electric line uses a locking element of a line gripper to join a bearing seat of the retaining frame. A guide bar is lagged in the locking element. The inner end of the guide bar is connected to an electric line coming from the lamp socket. The outer end of the guide bar forms a spherical seat having a groove and a screw hole. A locking screw having an acute end is locked in the spherical seat to penetrate the main electric line that traverses the groove of the spherical seat.

7 Claims, 6 Drawing Sheets

MODIFIED LINE LAMP

FIELD OF THE INVENTION

The present invention relates to a modified line lamp and, more particularly, to a modified line lamp that can be supported by a simple locking member.

BACKGROUND OF THE INVENTION

A line lamp in prior art connects serially a plurality of halogen lamps on a main electric line that is used to conduct electricity. There is no robust protection for the lamp socket and the lamp of the halogen lamp. The halogen lamp will shed if it can not be locked on the lamp socket. To improve this situation, a retaining frame is installed to enhance the lamp socket such that the main electric line connects with the lamp socket via an adapting electric line, and a protection lid is installed on a retaining seat to protect the lamp. But it is very inconvenient to replace the lamp for this structure.

SUMMARY AND OBJECTS OF THE PRESENT INVENTION

The object of the present invention is to provide a modified line lamp. The lamp obtains a support force, and a fixing seat of the lamp socket can be rotated to adjust the projection direction such that the replacement of the lamp is easier and more convenient.

The modified line lamp of the present invention comprises a lamp and a lamp socket. The lamp socket is connected to a fixing seat. A retaining frame is connected with two sides of the fixing seat. Two sides of the retaining frame are connected to a main electric line. A hole is disposed at each of the two sides of the retaining frame not connected with a main electric line. The fixing seat extends to form two bent arms from a tubular seat. A joining seat installed at the outer side of the middle section of the bent arm is connected pivotally to the hole to let a joining element be joined with the joining seat such that the fixing seat can swing. A locking member is installed at the end of the bent arm of the fixing seat to be locked with the periphery of the lamp. The main electric line uses a locking element of a line gripper to join a bearing seat of the retaining frame. A guide bar is lagged in the locking element. The inner end of the guide bar is connected to an electric line coming from the lamp socket. The outer end of the guide bar forms a spherical seat having a groove and a screw hole. A locking screw having an acute end is locked in the spherical seat to penetrate the main electric line that traverses the groove of the spherical seat.

The various objects and advantages of the present invention will be more readily understood from the following detailed description when read in conjunction with the appended drawings, in which:

DETAILED DESCRIPTION OF PREFERRED EMBODIMENT

Figure 1:
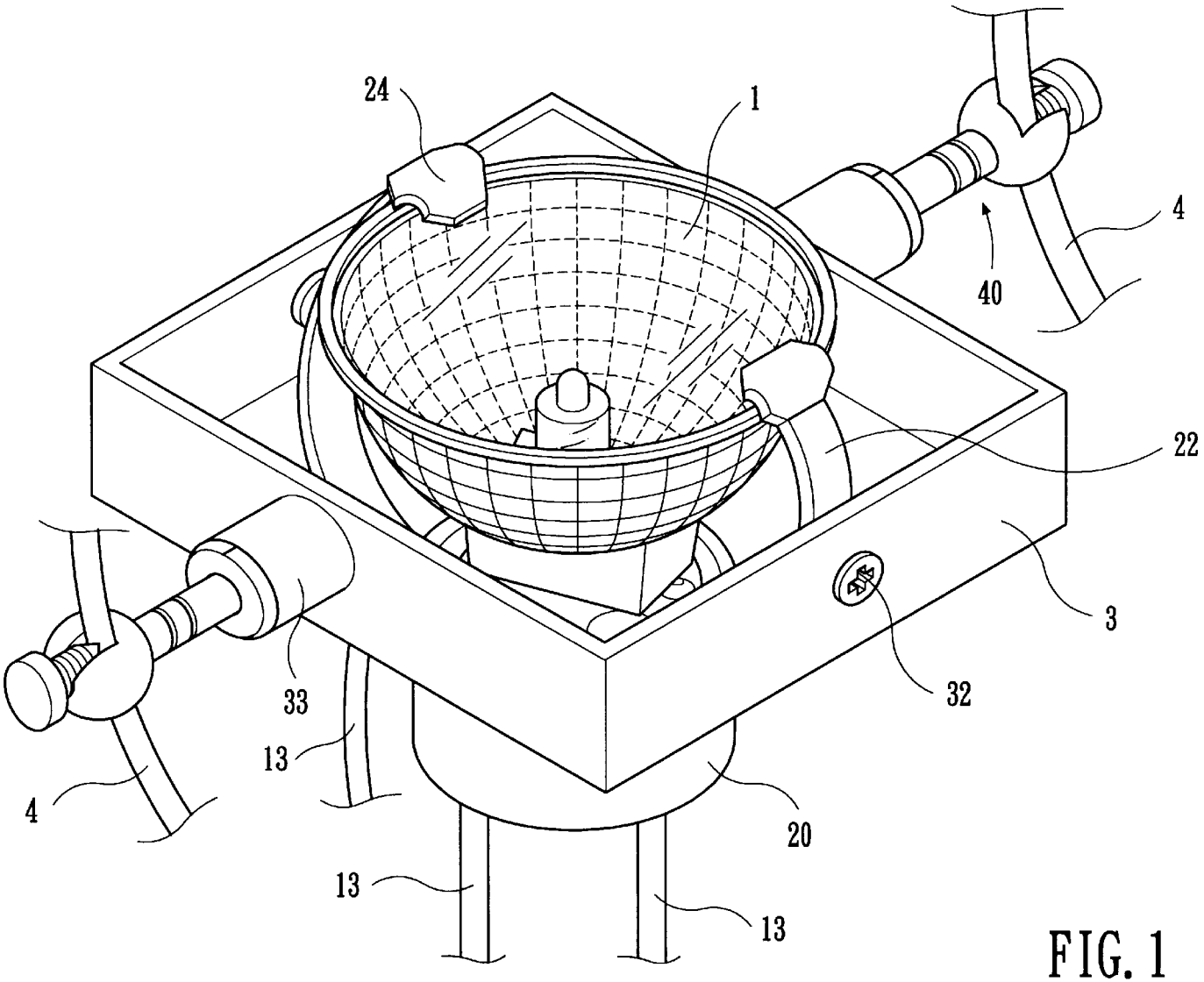
FIG. 1 is a perspective view according to a first embodiment of the present invention.
Figure 2:
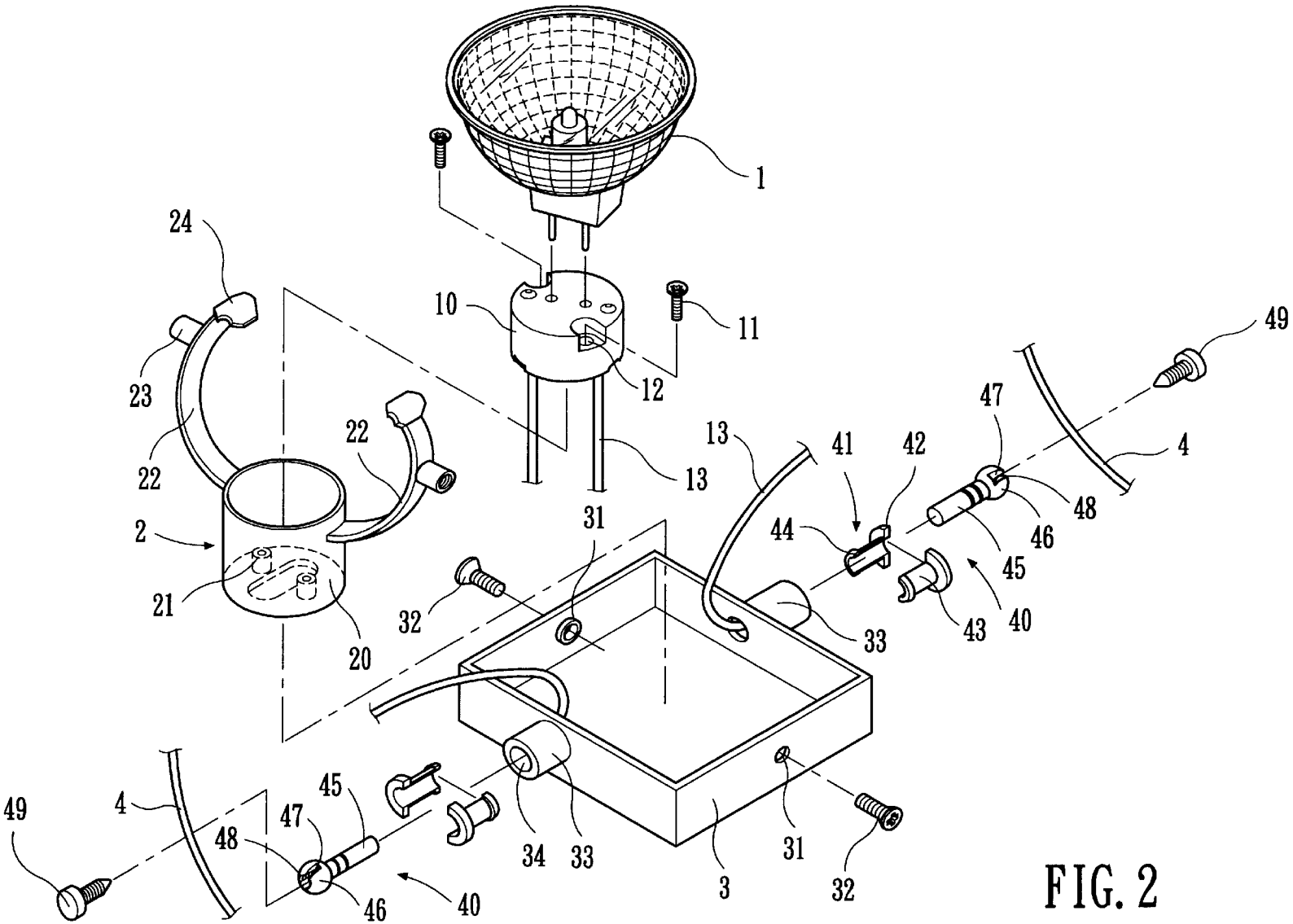
FIG. 2 is an exploded perspective view of the present invention.
Figure 3:
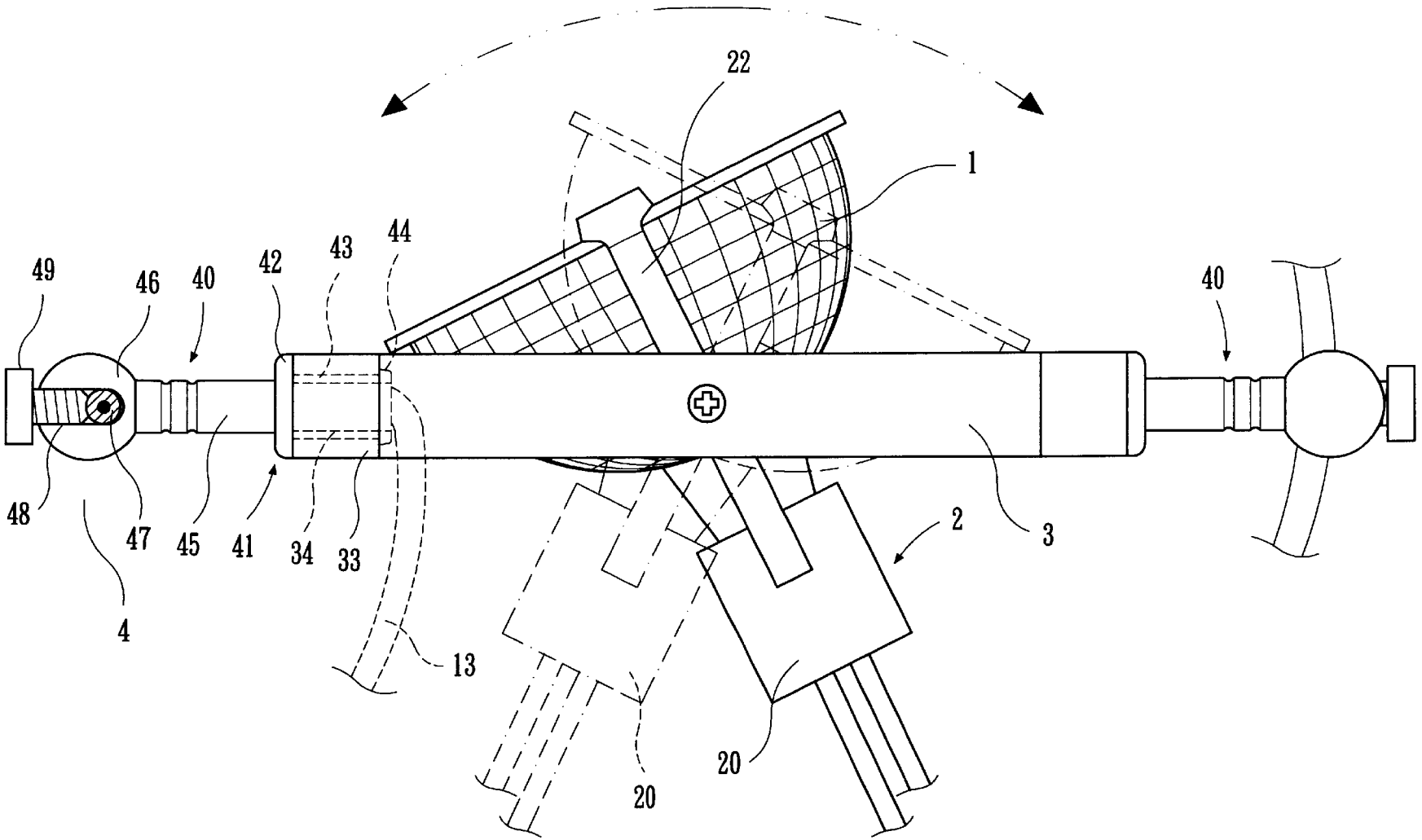
FIG. 3 is a side view showing the action of the present invention.
Figure 4:
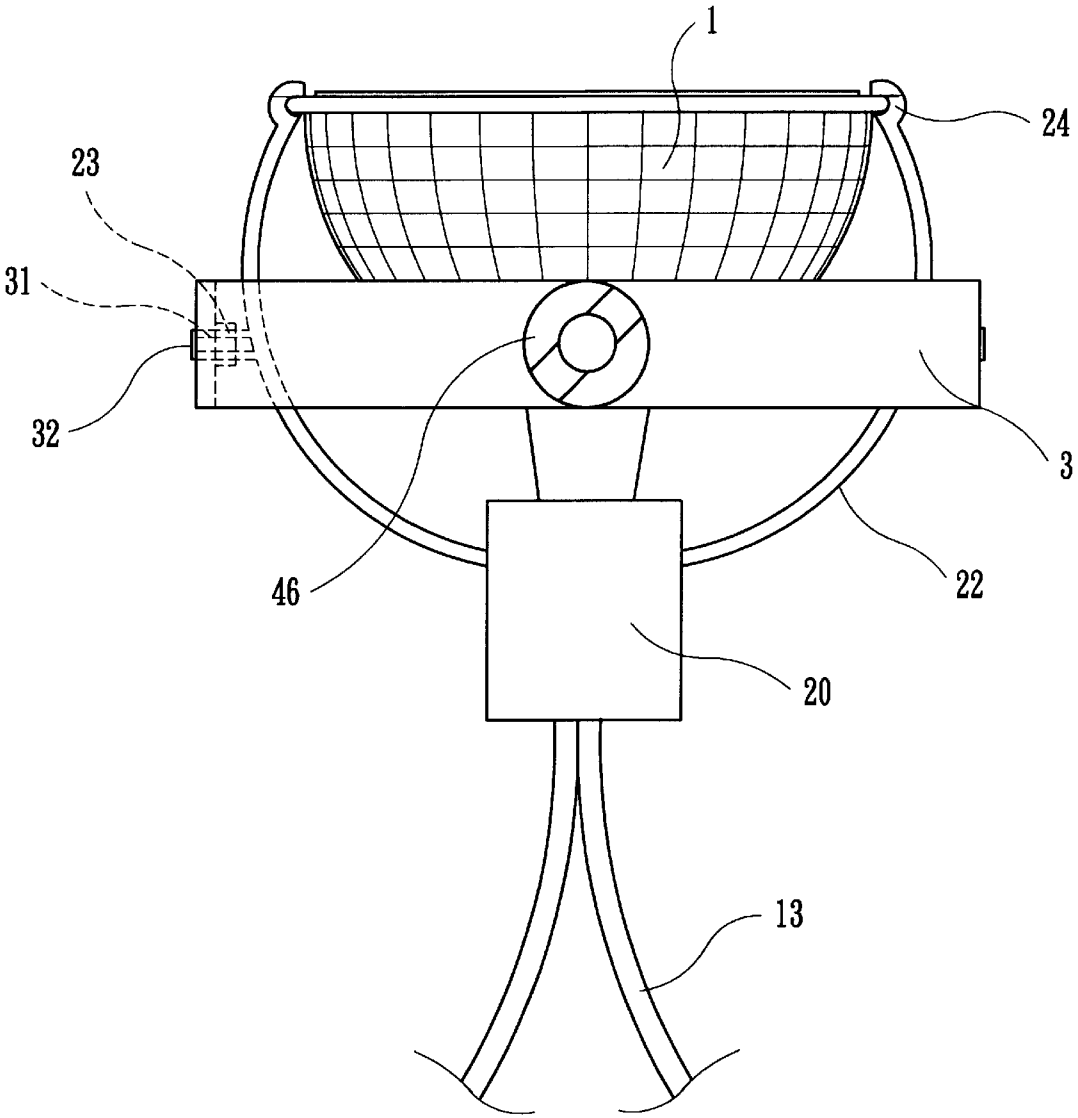
FIG. 4 is a side view of the present invention.
Figure 5:
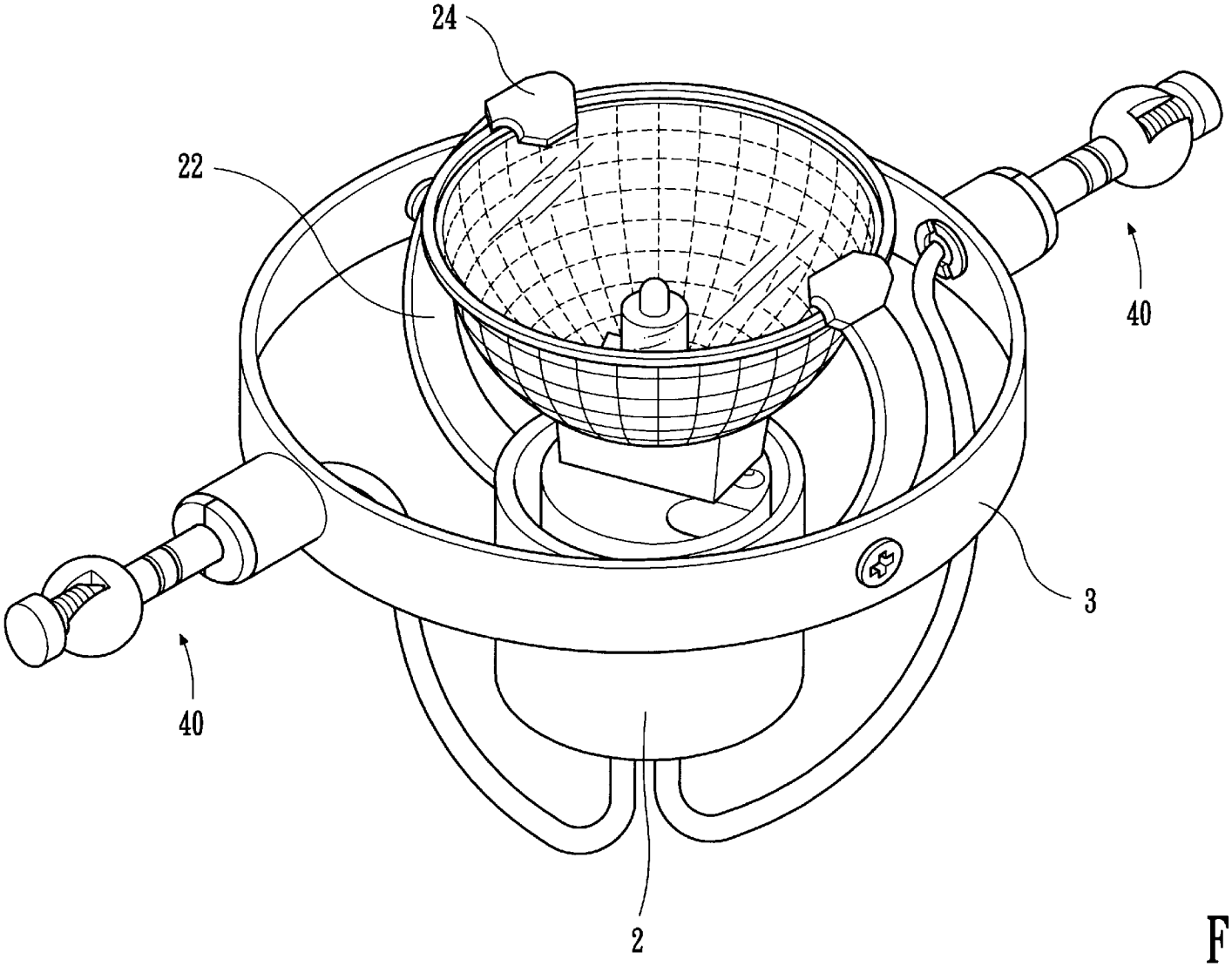
FIG. 5 is a perspective view according to a second embodiment of the present invention.
Figure 6:
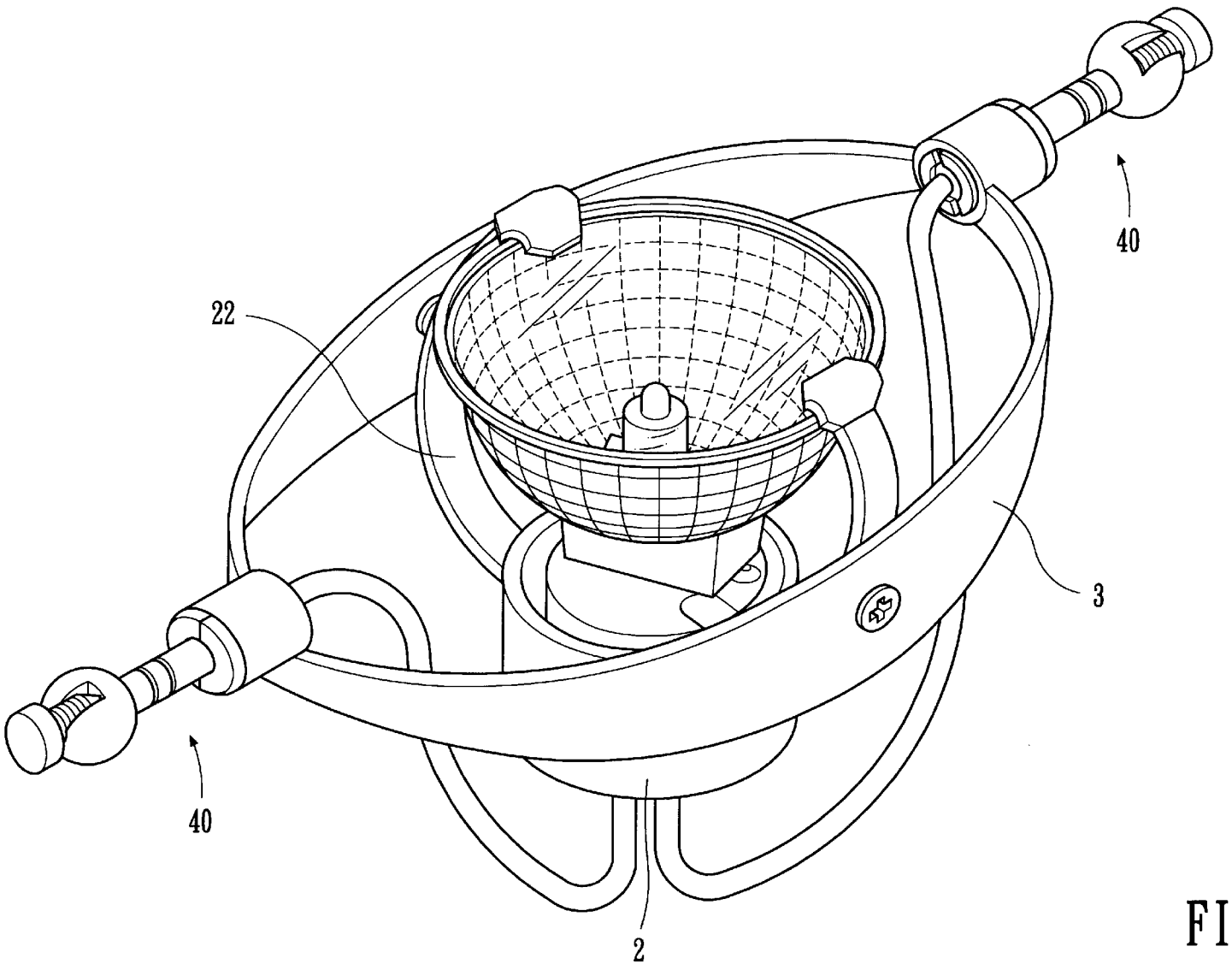
FIG. 6 is a perspective view according to a third embodiment of the present invention.

As shown in FIGS. 1 to 6, a modified line lamp of the present invention comprises a lamp 1 and a lamp socket 10. The lamp socket 10 is connected to a fixing seat 2. The lamp socket 10 is screwed at a screw seat 21 through a hole 12 via a pair of screws 11. A retaining frame 3 is connected with two sides of the fixing seat 2. A main electric line 4 is connected to each of two sides of the retaining frame 3. A hole 31 is disposed at each of the two sides of the retaining frame 3 not connected with a main electric line 4. The fixing seat 2 extends to form two bent arms 22 from a tubular seat 20. A joining seat 23 installed at the outer side of the middle section of the bent arm 22 is connected pivotally to the hole 31 to let a joining element 32 be joined with the joining seat 23. The screw shown can be a bolt or other similar joining element. As shown in FIG. 3, the fixing seat can swing within the range of the retaining frame 3. A locking member 24 is installed at the end of the bent arm 22 of the fixing seat 2 to be locked with the periphery of the lamp 1. The locking member 24 forms a hand shape with a groove for locking on the periphery of the lamp. The main electric line 4 uses a locking element 41 of a line gripper 40 to join a bearing seat 33 of the retaining frame 3. The locking element 41 has an annular portion 42 at the outer side of the bearing seat 33. A pair of separate locking plates 43 extend into a through hole 34 of the bearing seat 33. The hook end 44 of the locking plate 43 is locked with the inner end of the bearing seat 3. A guide bar 45 is lagged in the locking element 41. The inner end of the guide bar 45 is connected to an electric line 13 coming from the lamp socket 10. The outer end of the guide bar 45 forms a spherical seat 46 having a groove 47 and a screw hole 48. A locking screw 49 having an acute end is locked in the spherical seat 46 to penetrate the main electric line 4 that traverses the groove of the spherical seat 46 so as to conduct electricity. The retaining frame 3 shown in FIGS. 1 to 4 is of rectangular frame shape. The retaining frame 3 can also be of circular frame shape shown in FIG. 5 or of elliptical frame shape shown in FIG. 6.

To sum up, the present invention is characterized in that the bent arm 22 of the fixing seat 2 has a locking member 24 of hand shape to be locked with the periphery of the lamp 1 such that the lamp 1 will not shed and the lamp 1 can be detached by only pulling open the two bent arms 22. The lamp shown is a halogen lamp which is a better projecting lamp, but it is not limited to this kind of lamp. The present invention is also characterized in that the line gripper 40 is used to penetrate the main electric line for conducting electricity so as to be assembled conveniently and quickly. The present invention can provide better protection and better usage state for the lamp.

Although the present invention has been described with reference to the preferred embodiments thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

I claim:

1. A modified line lamp comprising a lamp, a lamp socket having a pair of electrical leads extending therefrom, a fixing seat connected to said lamp socket, a retaining frame having said fixing seat pivotally connected to a pair of first sides of said retaining frame for rotative displacement of said lamp socket relative to said retaining frame, and a pair of line grippers coupled to a pair of second sides of said retaining frame, each of said line grippers being both mechanically and electrically connected to a respective conductor of a main electric line, each of said line grippers electrically connecting said respective conductor of the main electric line to a corresponding one of said pair of electrical leads, said fixing seat having two bent arms extending from a tubular seat, each of said bent arms having a joining seat installed at an outer side of a middle section of said bent arm for receiving a joining element therein to provide said pivotal connection with said retaining frame, each said bent arm having a locking member installed at a distal end thereof for engaging a periphery of said lamp.

2. The modified line lamp of claim 1 wherein each of said line grippers includes a guide bar having an inner end coupled to a respective one of said electrical leads and an outer end coupled to a corresponding conductor of the main electric line.

3. The modified line lamp of claim 2 wherein said guide bar has a slotted opening formed in said outer end thereof for receiving a corresponding conductor of the main electric line therein, said slotted opening having a transversely directed threaded portion formed therein, each said line gripper including a locking screw threadedly engaged with said threaded portion of said slotted opening and having a distal end adapted to pierce insulation of said corresponding conductor of the main electric line.

4. The modified line lamp of claim 2 wherein said retaining frame includes a pair of bearing seats respectively formed on said pair of second sides thereof, each of said line grippers including a locking element disposed in a respective one of said bearing seats and having an opening for receiving a respective guide bar therein.

5. The modified line lamp of claim 2 wherein said locking element is formed by a pair of locking plates disposed in a respective one of said pair of bearing seats.

6. A modified line lamp comprising a lamp and a lamp socket said lamp socket being connected to a fixing seat, a retaining frame being connected with two sides of said fixing seat, two sides of said retaining frame being connected to a main electric line, a hole being disposed at each of the two sides of said retaining frame not connected with said main electric line, said fixing seat extending to form two bent arms from a tubular seat, a joining seat installed at the outer side of the middle section of said bent arm being connected pivotally to the hole to let a joining element be joined with said joining seat such that said fixing seat can swing, a locking member being installed at the end of said bent arm of said fixing seat to be locked with the periphery of said lamp, said two sides of said retaining frame being respectively connected to said main electric line by a pair of line grippers, each line gripper includes a locking element joining a bearing seat of said retaining frame, a guide bar being lagged in said locking element, the inner end of said guide bar being connected to an electric line coming from said lamp socket, the outer end of said guide bar forming a spherical seat having a groove and a screw hole, a locking screw having an acute end being locked in said spherical seat to penetrate said electric line that traverses said groove of said spherical seat.

7. The modified line lamp of claim 6, wherein said locking element of said line gripper has an annular portion at the outer side of said bearing seat, a pair of separate locking plates extending into a through hole of said bearing seat, the hook end of said locking plate being locked with the inner end of said bearing seat.

* * * * *